US008864528B2

(12) United States Patent
Chung et al.

(10) Patent No.: US 8,864,528 B2
(45) Date of Patent: Oct. 21, 2014

(54) USB 3.0 TWO-WAY SOCKET JACK CONNECTOR STRUCTURE

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Chih-Ming Hsu, New Taipei (TW); Yung-Chang Lin, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 106 days.

(21) Appl. No.: 13/762,369

(22) Filed: Feb. 8, 2013

(65) Prior Publication Data

US 2013/0217272 A1 Aug. 22, 2013

(30) Foreign Application Priority Data

Feb. 17, 2012 (TW) ..... 101202954 U

(51) Int. Cl.

| | |
|---|---|
| ***H01R 4/66*** | (2006.01) |
| ***H01R 13/6582*** | (2011.01) |
| ***H01R 13/6597*** | (2011.01) |
| ***H01R 13/516*** | (2006.01) |
| *H01R 24/60* | (2011.01) |
| *H01R 107/00* | (2006.01) |

(52) U.S. Cl.

CPC ..... *H01R 13/516* (2013.01); *H01R 13/6582* (2013.01); *H01R 13/6597* (2013.01); *H01R 24/60* (2013.01); *H01R 2107/00* (2013.01)

USPC ..... 439/660; 439/108

(58) Field of Classification Search

USPC ..... 439/660, 108

See application file for complete search history.

(56) References Cited

U.S. PATENT DOCUMENTS

| | | | | |
|---|---|---|---|---|
| 8,172,585 | B2 * | 5/2012 | Chiu et al. | 439/108 |
| 2013/0115822 | A1 * | 5/2013 | Pan et al. | 439/660 |
| 2013/0178112 | A1 * | 7/2013 | Su et al. | 439/660 |

* cited by examiner

*Primary Examiner* — Gary Paumen

(74) *Attorney, Agent, or Firm* — Leong C. Lei

(57) ABSTRACT

A USB 3.0 socket jack connector structure allows a USB plug connector to conduct working when it is plugged in the jack connector of the present invention positively or oppositely through a two-war sharing grounding transmission conductor, and a first signal transmission conductor, second signal transmission conductor, first differential signal transmission conductor, second differential signal transmission conductor, third grounding transmission conductor, third differential signal transmission conductor, fourth differential signal transmission conductor, first power supply transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor.

10 Claims, 10 Drawing Sheets

USB 3.0 TWO-WAY SOCKET JACK CONNECTOR STRUCTURE

TECHNICAL FIELD OF THE INVENTION

The present invention relates to a connector, and more particularly to a USB 3.0 two-way socket jack connector structure, in which a USB plug connector can be plugged positively or oppositely to conduct working in either way.

DESCRIPTION OF THE PRIOR ART

Connectors are very broad in use including connectors such as USB. USB 3.0 connectors are improved incessantly and the transmission speed thereof is increased too.

General conventional USB 3.0 jack connector defines a socket, and a tongue piece is disposed in the socket. A plurality of metal conductors are configured on the tongue piece through which a plug connector can be plugged in. Furthermore, these metal conductors are positioned at a place adjacent to one side wall of the socket, namely, the place is not in the middle of the socket. A partition plate of a plug connector will be in differential connection with the metal conductors on the tongue piece while the plug connector is plugged, thereby carrying out USB 3.0 jack connector. data transmission.

However, conventional USB 3.0 jack connectors have the following disadvantage in use:

A plug could not be plugged oppositely into a USB 3.0 jack connector, because the tongue piece thereof is positioned close to one side wall of a socket. If the tongue piece is moved to the middle of the socket, the plug connector cannot be in electric connection with metal conductors on the jack connector if the plug connector is plugged therein oppositely. As a result, a user must observe the position of the tongue piece of the jack connector first before plugging it, and then adjusts the direction of the plug connector to plug it positively.

SUMMARY OF THE INVENTION

To improve the disadvantage, the present invention proposes a USB 3.0 two-way socket jack connector structure, in which a USB plug connector can be plugged positively or oppositely to conduct working in either way.

The main object of the present invention is to provide a USB 3.0 two-way socket jack connector structure, allowing working to be conducted in either way when a USB plug connector is plugged into a jack connector of the present invention positively or oppositely by means of the configurations and particular arrangements of a plurality of transmission conductors.

To achieve the object mentioned above, the main structure of the present invention includes a grounding transmission conductor, first signal transmission conductor, second signal transmission conductor, first differential signal transmission conductor, second differential signal transmission conductor, third grounding transmission conductor, third differential signal transmission conductor, fourth differential signal transmission conductor, first power supply transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor. When a USB plug connector is plugged positively in a jack connector of the present invention, the metal transmission conductors on the USB plug connector are respectively in electric connection with the grounding transmission conductor, first signal transmission conductor, second signal transmission conductor, first differential signal transmission conductor, second differential signal transmission conductor, third grounding transmission conductor, third differential signal transmission conductor, fourth differential signal transmission conductor and first power supply transmission conductor; when a USB plug connector is plugged oppositely in a jack connector of the present invention, the metal transmission conductors on the USB plug connector are then respectively in electric connection with the grounding transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor, thereby achieving the advantage of a USB being conducted electrically no matter it is in a positive mode or opposite mode.

By means of the technology mentioned above, the present invention can solve the problem existing in conventional USB 3.0 jack connectors that a plug could not be plugged oppositely into the USB 3.0 jack connector, because a tongue piece thereof is positioned close to one side wall of a socket. If the tongue piece is moved to the middle of the socket, the plug connector cannot be in electric connection with metal conductors on the jack connector when the plug connector is plugged therein oppositely, and therefore, a user must observe the position of the tongue piece of the jack connector first before plugging it, and then adjusts the direction of the plug connector to plug it positively.

DETAILED DESCRIPTION OF THE PREFERRED EMBODIMENTS

Figure 1:
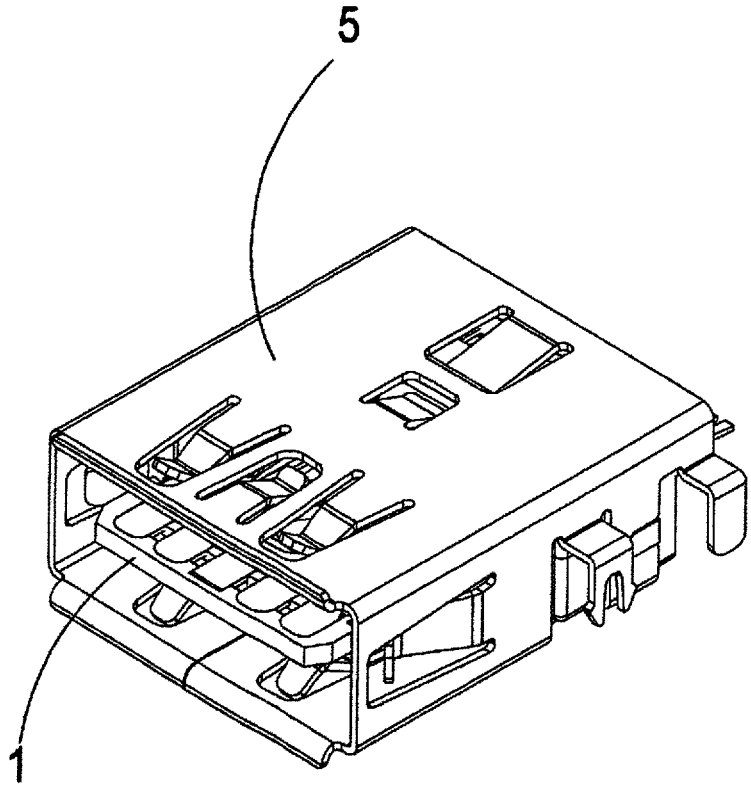
FIG. 1 is a perspective view of a preferred embodiment according to the present invention.
Figure 2:
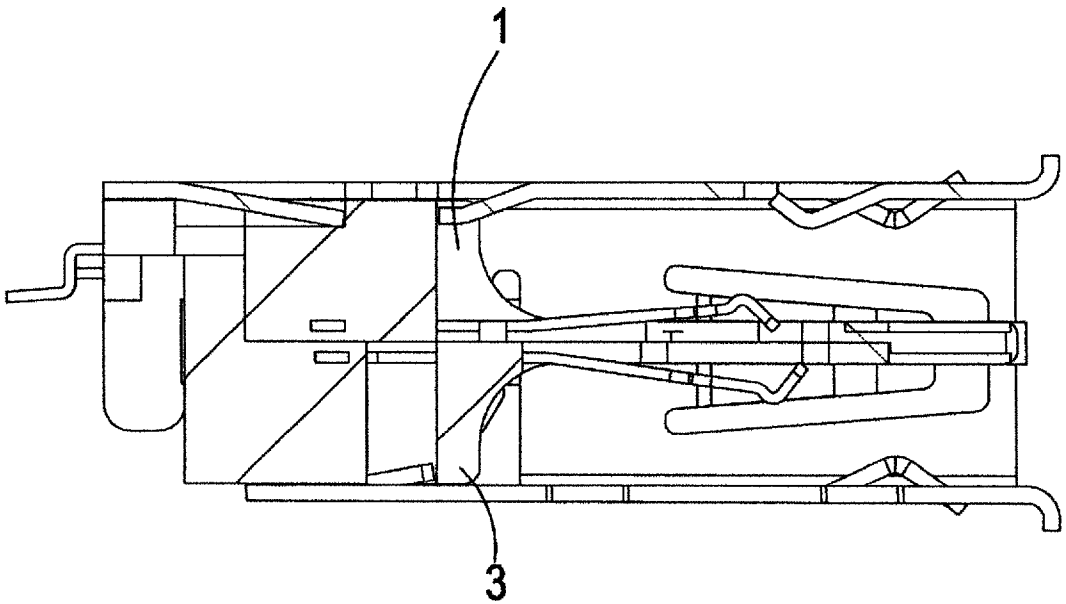
FIG. 2 is a cross sectional view of the embodiment according to the present invention.
Figure 3:
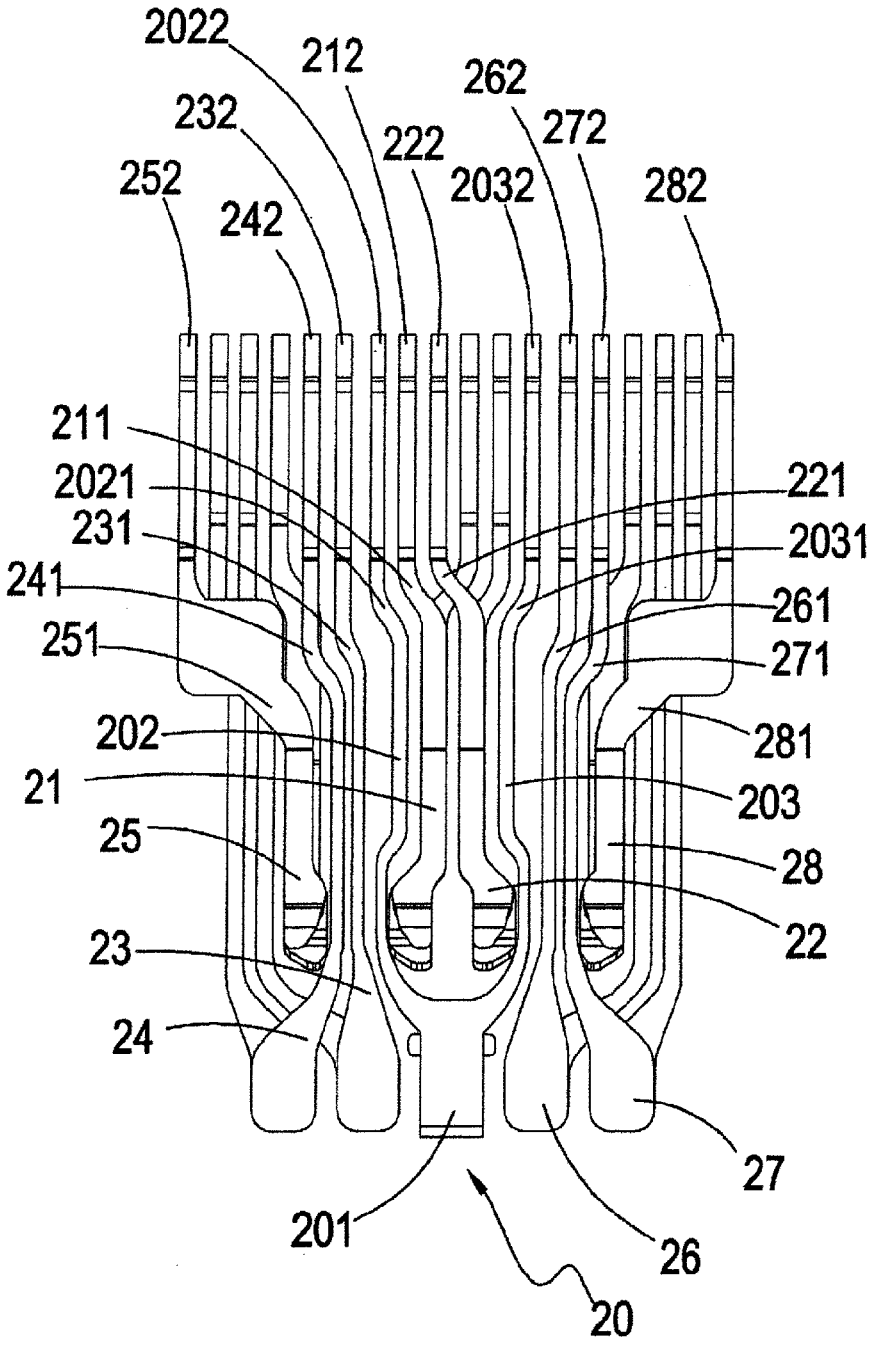
FIG. 3 is a partly schematic view of the embodiment according to the present invention.
Figure 4:
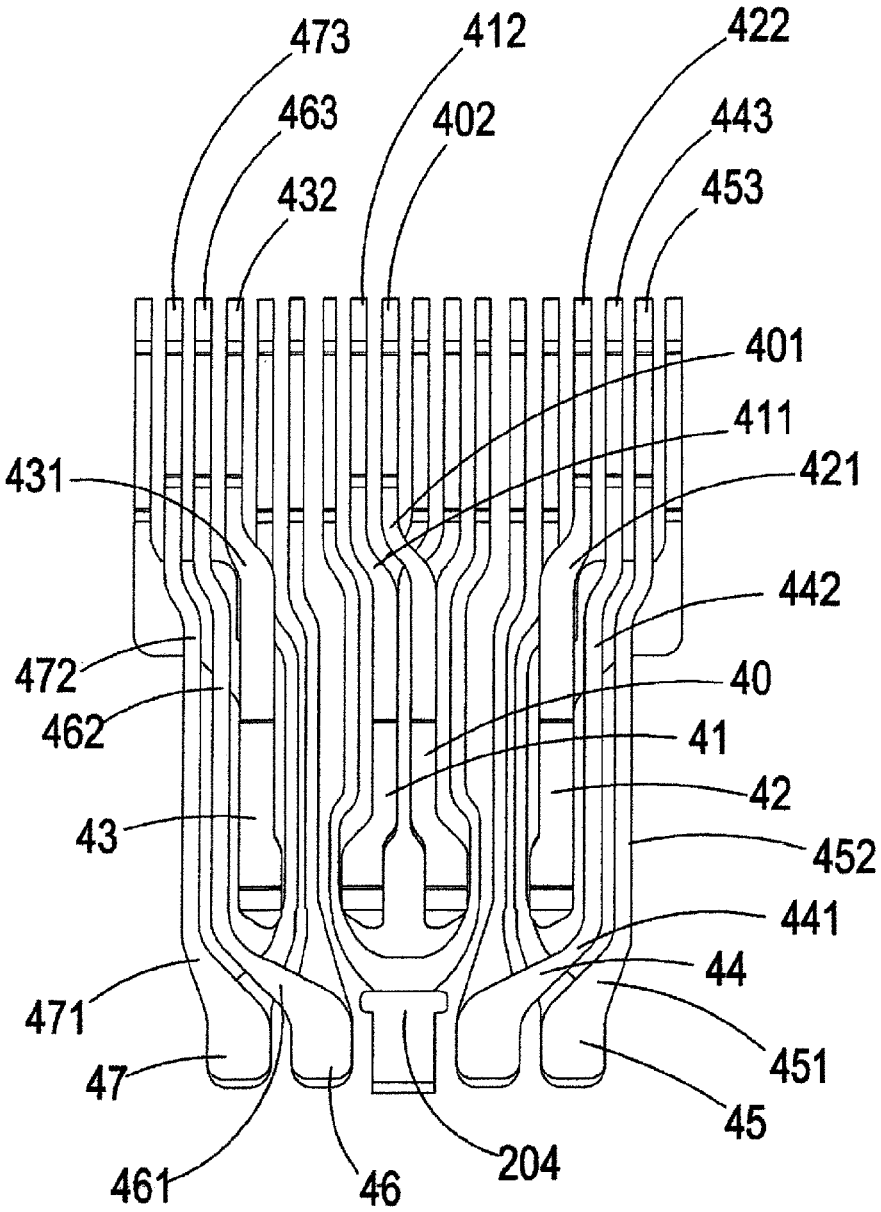
FIG. 4 is another partly schematic view of the embodiment according to the present invention.
Figure 5:
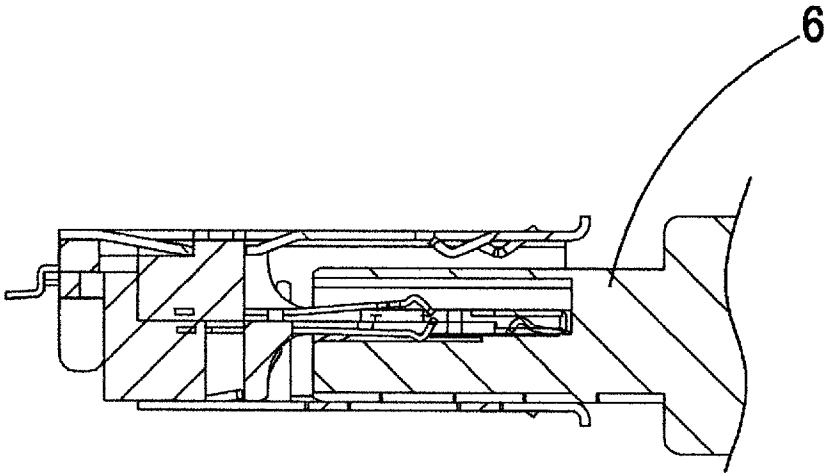
FIG. 5 is a schematic of a USB plug connector in a positive plug mode while the present invention is put into practice.
Figure 6:
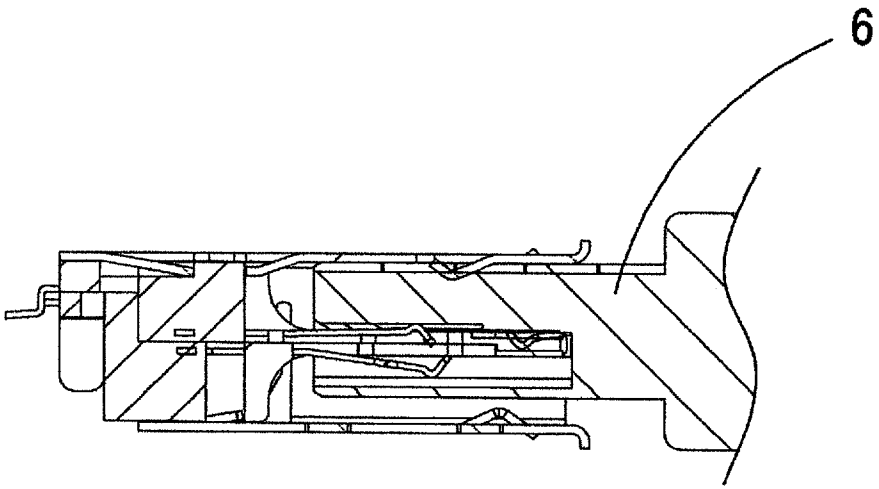
FIG. 6 is a schematic of a USB plug connector in an opposite plug mode while the present invention is put into practice.

Referring to FIGS. 1 to 4, which respectively are a perspective, cross sectional, partly schematic and partly schematic views of a preferred embodiment of the present invention, a USB 3.0 socket jack connector structure mainly includes a first insulating substrate 1, grounding transmission conductor 20, first signal transmission conductor 21, second signal transmission conductor 22, first differential signal transmission conductor 23, second differential signal transmission conductor 24, third grounding transmission conductor 25, third differential signal transmission conductor 26, fourth differential signal transmission conductor 27, first power supply transmission conductor 28, second insulating substrate 3, third signal transmission conductor 40, fourth signal transmission conductor 41, second power supply transmission conductor 42, fourth grounding transmission conductor 43, fifthexte differential signal transmission conductor 44, sixth differential signal transmission conductor 45, seventh differential signal transmission conductor 46, eighth differential signal transmission conductor 47, and shielding housing 5.

The grounding transmission conductor 20 is disposed on the first insulating substrate 1, one end thereof defines a first grounding contact portion 201 bended oppositely, which is diverged at one end thereof and respectively extended with a first grounding extension portion 202 and second grounding extension portion 203. A first grounding bended portion 2021 and first grounding soldering portion 2022 are defined on the first grounding extension portion 202, and a second grounding bended portion 2031 bended in a direction opposite to the first grounding bended portion 2021 and a second grounding soldering portion 2032 are defined on the second grounding extension portion 203. Furthermore, another end of the grounding transmission conductor 20 is bended oppositely and extended to form a second grounding contact portion 204.

The first signal transmission conductor 21 is disposed on the first insulating substrate 1 and positioned between the first grounding extension portion 202 and second grounding extension portion 203, the first signal transmission conductor 21 defines a first signal bended portion 211 bended in a direction similar to the first grounding bended portion 2021, and one end of the first signal transmission conductor 21 defines a first signal soldering portion 212.

The second signal transmission conductor 22 is disposed on the first insulating substrate 1 and positioned between the first signal transmission conductor 21 and the second grounding extension portion 203, the second signal transmission conductor 22 defines a second signal bended portion 221 bended in a direction similar to the first signal bended portion 211, and one end of the second signal transmission conductor 22 defines a second signal soldering portion 222.

The first differential signal transmission conductor 23 is disposed on the first insulating substrate 1 and positioned at the side of the grounding transmission conductor 20, the first differential signal transmission conductor 23 defines a first differential signal bended portion 231 bended in a direction similarly to the first grounding bended portion 2021, and one end of the first differential signal transmission conductor 23 defines a first differential signal soldering portion 232 positioned at the side of the first grounding soldering portion 2022 deviating from the first signal soldering portion 212.

The second differential signal transmission conductor 24 is disposed on the first insulating substrate 1 and positioned at the side of the first differential signal transmission conductor 23 deviating from the grounding transmission conductor 20, the second differential signal transmission conductor 24 defines a second differential signal bended portion 241 bended in a direction similar to the first differential signal bended portion 231, and one end of the second differential signal transmission conductor 24 defines a second differential signal soldering portion 242.

The third grounding transmission conductor 25 is disposed on the first insulating substrate 1 and positioned at the side of the second differential signal transmission conductor 24 deviating from the first differential signal transmission conductor 23, the third grounding transmission conductor 25 defines a third grounding bended portion 251 bended in a direction similar to the second differential signal bended portion 241, and one end of the third grounding transmission conductor 25 defines a third grounding soldering portion 252.

The third differential signal transmission conductor 26 is disposed on the insulating substrate 1 and positioned at the side of the grounding transmission conductor 20 deviating from the first differential signal transmission conductor 23, the third differential signal transmission conductor 26 defines a third differential signal bended portion 261 bended in a direction similar to the second grounding bended portion 2031, and one end of the third differential signal transmission conductor 26 defines a third differential signal soldering portion 262.

The fourth differential signal transmission conductor 27 is disposed on the first insulating substrate 1 and positioned at the side of the third differential signal transmission conductor 26 deviating from the grounding transmission conductor 20, the fourth differential signal transmission conductor 27 defines a fourth differential signal bended portion 271 bended in a direction similar to the third differential signal bended portion 261, and one end of the fourth differential signal transmission conductor 27 defines a fourth differential signal soldering portion 272.

The first power supply transmission conductor 28 is disposed on the first insulating substrate 1 and positioned at the side of the fourth differential signal transmission conductor 27 deviating from the third differential signal transmission conductor 26, the first power supply transmission conductor 28 defines a first power supply bended portion 281 bended in a direction similar to the fourth differential signal bended portion 271, and one end of the first power supply transmission conductor 28 defines a first power supply soldering portion 282.

The second insulation substrate 3 is stacked with and coupled to the first insulating substrate 1.

The third signal transmission conductor 40 is disposed on the second insulating substrate 3 and positioned on one face of the first signal transmission conductor 21, the third signal transmission conductor 40 defines a third signal bended portion 401 bended in a direction opposite to the first signal bended portion 211, and one end of the third signal transmission conductor 40 defines a third signal soldering portion 402 positioned between the second signal soldering portion 222 and the second grounding soldering portion 2032.

The fourth signal transmission conductor 41 is disposed on the second insulating substrate 3 and positioned on one face of the second signal transmission conductor 22, the fourth signal transmission conductor 41 defines a fourth signal bended portion 411 bended in a direction similar to the third signal bended portion 401, and one end of the fourth signal transmission conductor 41 defines a fourth signal soldering portion 412 positioned between the third signal soldering portion 402 and the second grounding soldering portion 2032.

The second power supply transmission conductor 42 is disposed on the second insulating substrate 3, and positioned on one face of the third grounding transmission conductor 25, the second power supply transmission conductor 42 defines a second power supply bended portion 421 bended in a direction similar to the third grounding bended portion 251, and one end of the second power supply transmission conductor 42 defines a second power supply soldering portion 422 positioned between the second differential signal soldering portion 242 and the third grounding soldering portion 252.

The fourth grounding transmission conductor 43 is disposed on the second insulating substrate 3 and positioned on one face of the first power supply transmission conductor 28, the fourth grounding transmission conductor 43 defines a fourth grounding bended portion 431 bended in a direction similar to the first power supply bended portion 281, and one end of the fourth grounding transmission conductor 43 defines a fourth grounding soldering portion 432 positioned between the fourth differential signal soldering portion 272 and the first power supply soldering portion 282.

The fifth differential signal transmission conductor 44 is disposed on the second insulating substrate 3 and positioned on one face of the first differential signal transmission conductor 23, the fifth differential signal transmission conductor 44 defines a fifth differential signal bended portion 441 bended in a direction similar to the first differential signal bended portion 231, the fifth differential signal bended portion 441 is extended toward one end thereof to define a fifth differential signal extension portion 442 positioned at one side of the second power supply transmission conductor 42, and one end of the fifth differential signal extension portion 442 defines a fifth differential signal soldering portion 443 positioned between the second power supply soldering portion 422 and the third grounding soldering portion 252.

The sixth differential signal transmission conductor 45 is disposed on the second insulating substrate 3, positioned on one face of the second differential signal transmission conductor 24, and juxtaposed with the fifth differential signal transmission conductor 44, the sixth differential signal transmission conductor 45 defines a sixth differential signal bended portion 451 bended in a direction similar to the fifth differential signal bended portion 441, and the sixth differential signal bended portion 451 is extended toward one end thereof to define a sixth differential signal extension portion 452 positioned at the side of the fifth differential signal extension portion 442 deviating from the second power supply transmission conductor 42, and one end of the sixth differential signal extension portion 452 defines a sixth differential signal soldering portion 453 positioned between the fifth differential signal soldering portion 443 and the third grounding soldering portion 252.

The seventh differential signal transmission conductor 46 is disposed on the second insulating substrate 3 and positioned on one face of the third differential signal transmission conductor 26, the seventh differential signal transmission conductor 46 defines a seventh differential signal bended portion 461 bended in a direction similar to the third differential signal bended portion 261, and the seventh differential signal bended portion 461 is extended toward one end thereof to define a seventh differential signal extension portion 462 positioned at one side of the fourth grounding transmission conductor 43, and one end of the seventh differential signal extension portion 462 defines a seventh differential signal soldering portion 463 positioned between the fourth grounding soldering portion 432 and the first power supply soldering portion 282.

The eighth differential signal transmission conductor 47 is disposed on the second insulating substrate 3, positioned on one face of the fourth differential signal transmission conductor 27, and juxtaposed with the seventh differential signal transmission conductor 46, the eighth differential signal transmission conductor 47 defines an eighth differential signal bended portion 471 bended in a direction similar to the seventh differential signal bended portion 461, and the eighth differential signal bended portion 471 is extended toward one end thereof to define an eighth differential signal extension portion 472 positioned at the side of the seventh differential signal extension portion 462 deviating from the fourth grounding transmission conductor 43, and one end of the eighth differential signal extension portion 472 defines an eighth differential signal soldering portion 473 positioned between the seventh differential signal soldering portion 463 and the first power supply soldering portion 282.

The shielding housing 5 covers the first insulating substrate 1 and second insulating substrate 3.

The use and operation of the present invention are described as the following through the above-mentioned structure and configuration designs. Referring to FIGS. 1 to 6, which respectively are a perspective view, cross sectional view, partly schematic view, partly schematic, schematic view of a USB plug connector while being taken practice in a positive plug mode, and schematic view of a USB plug connector while being taken practice in an opposite plug mode. When a USB plug connector 6 is plugged positively in a jack connector of the present invention, the metal transmission conductors on the USB plug connector are respectively in electric connection with the grounding transmission conductor 20, first signal transmission conductor 21, second signal transmission conductor 22, first differential signal transmission conductor 23, second differential signal transmission conductor 24, third grounding transmission conductor 25, third differential signal transmission conductor 26, fourth differential signal transmission conductor 27 and first power supply transmission conductor 28; when a USB plug connector 6 is plugged oppositely in a jack connector of the present invention, the metal transmission conductors on the USB plug connector are then respectively in electric connection with the grounding transmission conductor 20, third signal transmission conductor 40, fourth signal transmission conductor 41, second power supply transmission conductor 42, fourth grounding transmission conductor 43, fifth differential signal transmission conductor 44, sixth differential signal transmission conductor 45, seventh differential signal transmission conductor 46 and eighth differential signal transmission conductor 47. Furthermore, it can be seen clearly from the figures that the grounding transmission conductor 20 is used as a transmission conductor shared by the USB plug connector 6 in the positive plug mode and the USB plug connector 6 in the opposite plug mode. Therefore, the present invention provides the advantage that conductibility can be carried out in both positive and opposite plug modes.

Figure 7:
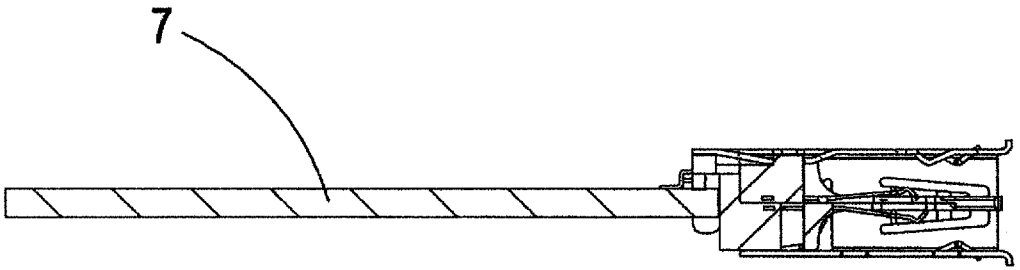
FIG. 7 is a schematic view of the present invention coupled to a printing circuit board while the present invention is put into practice.

Referring to FIG. 7, which is a schematic view of the present invention coupled to a printing circuit board, the grounding transmission conductor, first signal transmission conductor, second signal transmission conductor, first differential signal transmission conductor, second differential signal transmission conductor, third grounding transmission conductor, third differential signal transmission conductor, fourth differential signal transmission conductor, first power supply transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor are all connected to a printing circuit board 7 at ends thereof by means of single row surface attachment (SMT), single row plug configuration (DIP), double row surface attachment (SMT), double-row plug configuration (DIP), upward bending extension (top mount), downward bending extension (reverse mount), continuous bending extension (sink boards). Furthermore, the top mount includes top mount flush or top mount stand-off, the reverse mount includes reverse mount flush or reverse mount stand-off, the sink board is forward sink board or backward sink board. Furthermore, the connection way may be vertical flush, vertical stand-off; vertical sink board, erect stand-off, erect flush or erect sink board, the figure shows continuous bending extension (sink board).

Figure 8:
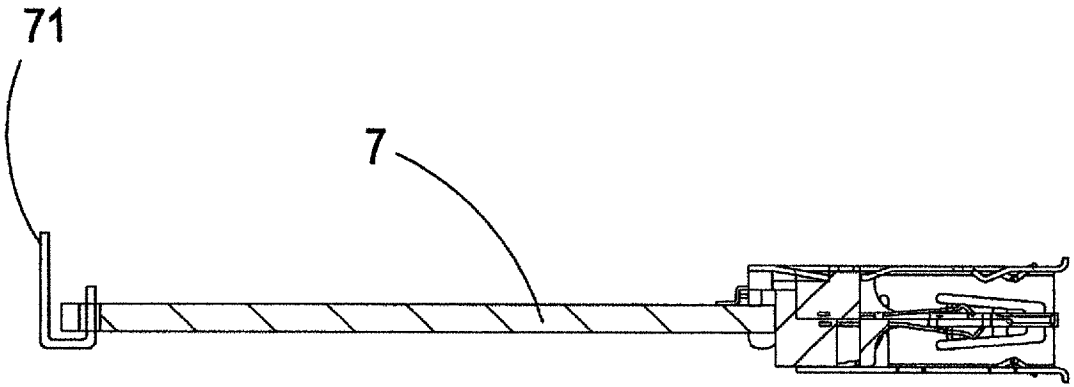
FIG. 8 is a schematic view of a printing circuit board in connection with a conversion terminal set while the present invention is put into practice.

Referring to FIG. 8, which is a schematic view of a printing circuit board coupled to a conversion terminal set, the printing circuit board 7 is further connected with a conversion terminal set by means of surface attachment (SMT), plug configuration (DIP) or clamp configuration, the figure shows plug configuration (DIP).

Figure 9:
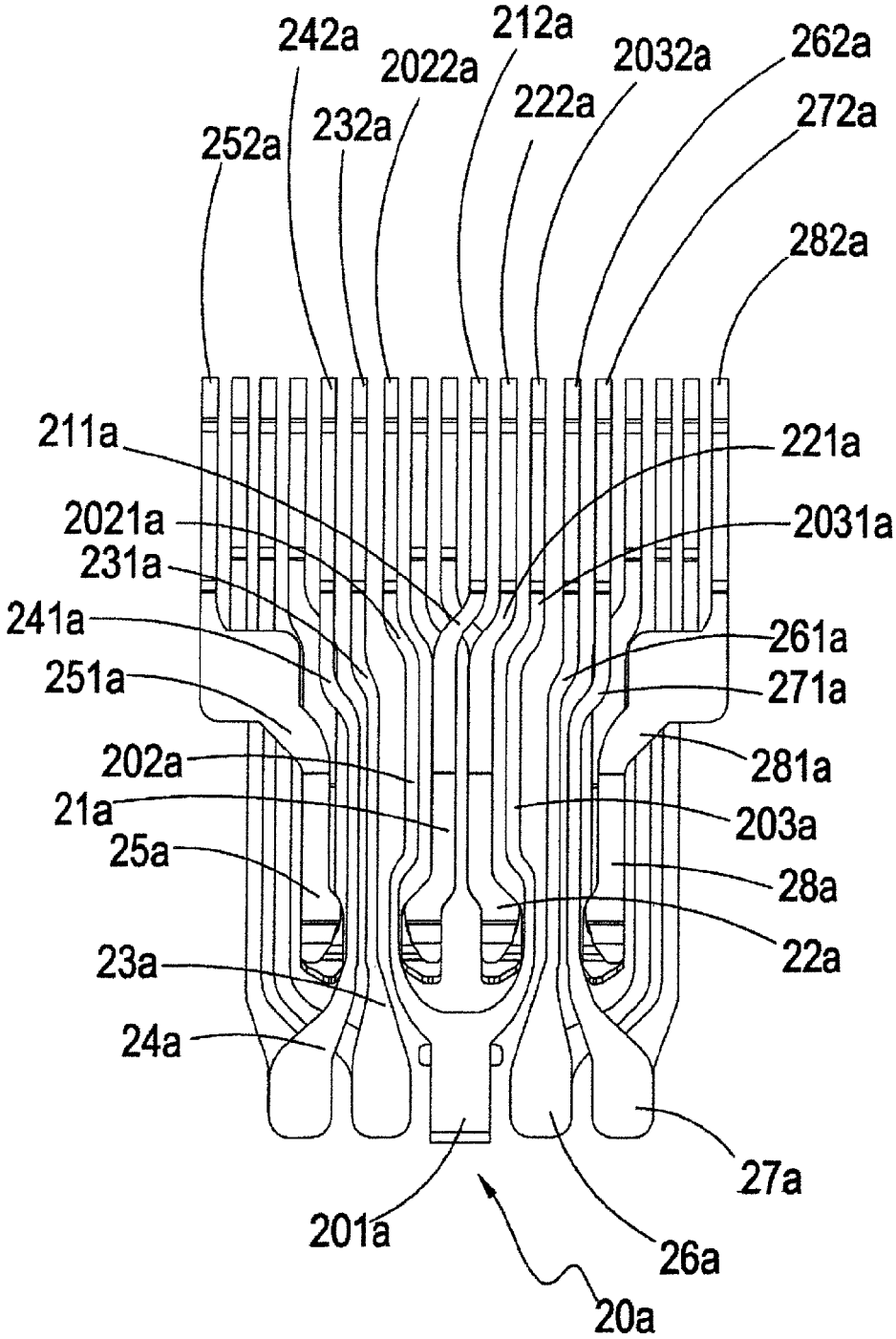
FIG. 9 is a partly schematic view of another preferred embodiment according to the present invention.
Figure 10:
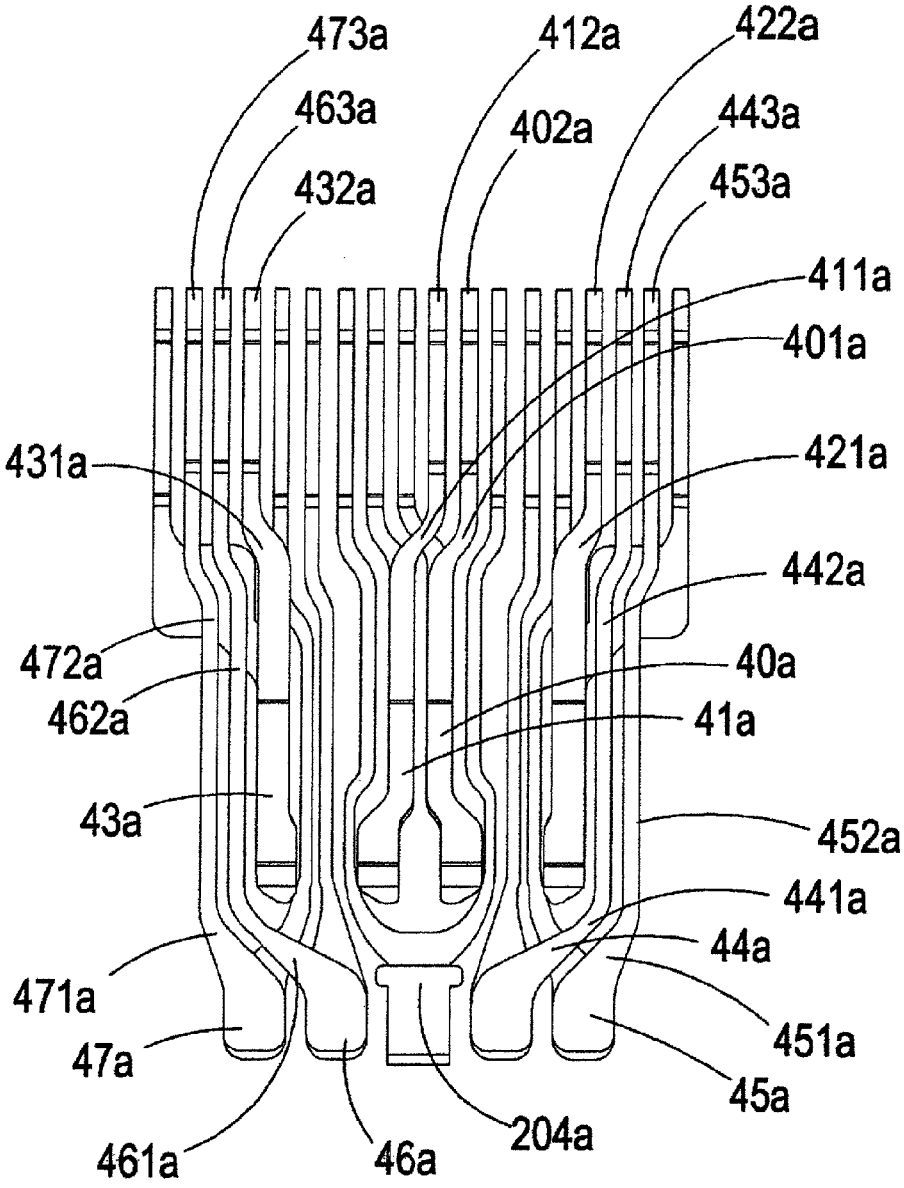
FIG. 10 is another partly schematic view of another preferred embodiment according to the present invention.

Referring to FIGS. 9 and 10, which are partly schematic views of another preferred embodiment of the present invention, a USB 3.0 socket jack connector structure mainly includes a first insulating substrate, grounding transmission conductor 20*a*, first signal transmission conductor 21*a*, second signal transmission conductor 22*a*, first differential signal transmission conductor 23*a*, second differential signal transmission conductor 24*a*, third grounding transmission conductor 25*a*, third differential signal transmission conductor 26*a*, fourth differential signal transmission conductor 27*a*, first power supply transmission conductor 28*a*, second insulating substrate, third signal transmission conductor 40*a*, fourth signal transmission conductor 41*a*, second power supply transmission conductor 42*a*, fourth grounding transmission conductor 43*a*, fifthexte differential signal transmission conductor 44*a*, sixth differential signal transmission conductor 45*a*, seventh differential signal transmission conductor 46*a*, eighth differential signal transmission conductor 47*a*, and shielding housing 5.

The grounding transmission conductor 20*a* is disposed on the first insulating substrate, one end thereof defines a first grounding contact portion 201*a* bended oppositely, which is diverged at one end thereof and respectively extended with a first grounding extension portion 202*a* and second grounding extension portion 203*a*. A first grounding bended portion 2021*a* and first grounding soldering portion 2022*a* are defined on the first grounding extension portion 202*a*, and a second grounding bended portion 2031*a* bended in a direction opposite to the first grounding bended portion 2021*a* and a second grounding soldering portion 2032*a* are defined on the second grounding extension portion 203*a*. Furthermore, another end of the grounding transmission conductor 20*a* is bended oppositely and extended to form a second grounding contact portion 204*a*.

The first signal transmission conductor 21*a* is disposed on the first insulating substrate and positioned between the first grounding extension portion 202*a* and second grounding extension portion 203*a*, the first signal transmission conductor 21*a* defines a first signal bended portion 211*a* bended in a direction opposite to the first grounding bended portion 2021*a*, and one end of the first signal transmission conductor 21*a* defines a first signal soldering portion 212*a*.

The second signal transmission conductor 22*a* is disposed on the first insulating substrate and positioned between the first signal transmission conductor 21*a* and the second grounding extension portion 203*a*, the second signal transmission conductor 22*a* defines a second signal bended portion 221*a* bended in a direction similar to the first signal bended portion 211*a*, and one end of the second signal transmission conductor 22*a* defines a second signal soldering portion 222*a*.

The first differential signal transmission conductor 23*a* is disposed on the first insulating substrate and positioned at the side of the grounding transmission conductor 20*a*, the first differential signal transmission conductor 23*a* defines a first differential signal bended portion 231*a* bended in a direction similarly to the first grounding bended portion 2021*a*, and one end of the first differential signal transmission conductor 23*a* defines a first differential signal soldering portion 232*a* positioned at the side of the first grounding soldering portion 2022*a* deviating from the first signal soldering portion 212*a*.

The second differential signal transmission conductor 24*a* is disposed on the first insulating substrate and positioned at the side of the first differential signal transmission conductor 23*a* deviating from the grounding transmission conductor 20*a*, the second differential signal transmission conductor 24*a* defines a second differential signal bended portion 241*a* bended in a direction similar to the first differential signal bended portion 231*a*, and one end of the second differential signal transmission conductor 24*a* defines a second differential signal soldering portion 242*a*.

The third grounding transmission conductor 25*a* is disposed on the first insulating substrate and positioned at the side of the second differential signal transmission conductor 24*a* deviating from the first differential signal transmission conductor 23*a*, the third grounding transmission conductor 25*a* defines a third grounding bended portion 251*a* bended in a direction similar to the second differential signal bended portion 241*a*, and one end of the third grounding transmission conductor 25*a* defines a third grounding soldering portion 252*a*.

The third differential signal transmission conductor 26*a* is disposed on the insulating substrate and positioned at the side of the grounding transmission conductor 20*a* deviating from the first differential signal transmission conductor 23*a*, the third differential signal transmission conductor 26*a* defines a third differential signal bended portion 261*a* bended in a direction similar to the second grounding bended portion 2031*a*, and one end of the third differential signal transmission conductor 26*a* defines a third differential signal soldering portion 262*a*.

The fourth differential signal transmission conductor 27*a* is disposed on the first insulating substrate and positioned at the side of the third differential signal transmission conductor 26*a* deviating from the grounding transmission conductor 20*a*, the fourth differential signal transmission conductor 27*a* defines a fourth differential signal bended portion 271*a* bended in a direction similar to the third differential signal bended portion 261*a*, and one end of the fourth differential signal transmission conductor 27*a* defines a fourth differential signal soldering portion 272*a*.

The first power supply transmission conductor 28*a* is disposed on the first insulating substrate and positioned at the side of the fourth differential signal transmission conductor 27*a* deviating from the third differential signal transmission conductor 26*a*, the first power supply transmission conductor 28*a* defines a first power supply bended portion 281*a* bended in a direction similar to the fourth differential signal bended portion 271*a*, and one end of the first power supply transmission conductor 28*a* defines a first power supply soldering portion 282*a*.

The second insulation substrate is stacked with and coupled to the first insulating substrate.

The third signal transmission conductor 40*a* is disposed on the second insulating substrate and positioned on one face of the first signal transmission conductor 21*a*, the third signal transmission conductor 40*a* defines a third signal bended portion 401*a* bended in a direction opposite to the first signal bended portion 211*a*, and one end of the third signal transmission conductor 40*a* defines a third signal soldering portion 402*a* positioned between the first signal soldering portion 212*a* and the first grounding soldering portion 2022*a*.

The fourth signal transmission conductor 41*a* is disposed on the second insulating substrate and positioned on one face of the second signal transmission conductor 22*a*, the fourth signal transmission conductor 41*a* defines a fourth signal bended portion 411*a* bended in a direction similar to the third signal bended portion 401*a*, and one end of the fourth signal transmission conductor 41*a* defines a fourth signal soldering portion 412*a* positioned between the third signal soldering portion 402*a* and the first signal soldering portion 212*a*.

The second power supply transmission conductor 42*a* is disposed on the second insulating substrate, and positioned on one face of the third grounding transmission conductor 25*a*, the second power supply transmission conductor 42*a* defines a second power supply bended portion 421*a* bended in a direction similar to the third grounding bended portion 251*a*, and one end of the second power supply transmission conductor 42*a* defines a second power supply soldering portion 422*a* positioned between the second differential signal soldering portion 242*a* and the third grounding soldering portion 252*a*.

The fourth grounding transmission conductor 43*a* is disposed on the second insulating substrate and positioned on one face of the first power supply transmission conductor 28*a*, the fourth grounding transmission conductor 43*a* defines a fourth grounding bended portion 431*a* bended in a direction similar to the first power supply bended portion 281*a*, and one end of the fourth grounding transmission conductor 43*a* defines a fourth grounding soldering portion 432*a* positioned between the fourth differential signal soldering portion 272*a* and the first power supply soldering portion 282*a*.

The fifth differential signal transmission conductor 44*a* is disposed on the second insulating substrate and positioned on one face of the first differential signal transmission conductor 23*a*, the fifth differential signal transmission conductor 44*a* defines a fifth differential signal bended portion 441*a* bended in a direction similar to the first differential signal bended portion 231*a*, the fifth differential signal bended portion 441*a* is extended toward one end thereof to define a fifth differential signal extension portion 442*a* positioned at one side of the second power supply transmission conductor 42*a*, and one end of the fifth differential signal extension portion 442 defines a fifth differential signal soldering portion 443*a* positioned between the second power supply soldering portion 422*a* and the third grounding soldering portion 252*a*.

The sixth differential signal transmission conductor 45*a* is disposed on the second insulating substrate, positioned on one face of the second differential signal transmission conductor 24*a*, and juxtaposed with the fifth differential signal transmission conductor 44*a*, the sixth differential signal transmission conductor 45*a* defines a sixth differential signal bended portion 451*a* bended in a direction similar to the fifth differential signal bended portion 441*a*, and the sixth differential signal bended portion 451*a* is extended toward one end thereof to define a sixth differential signal extension portion 452*a* positioned at the side of the fifth differential signal extension portion 442*a* deviating from the second power supply transmission conductor 42*a*, and one end of the sixth differential signal extension portion 452 defines a sixth differential signal soldering portion 453*a* positioned between the fifth differential signal soldering portion 443*a* and the third grounding soldering portion 252*a*.

The seventh differential signal transmission conductor 46*a* is disposed on the second insulating substrate and positioned on one face of the third differential signal transmission conductor 26*a*, the seventh differential signal transmission conductor 46*a* defines a seventh differential signal bended portion 461*a* bended in a direction similar to the third differential signal bended portion 261*a*, and the seventh differential signal bended portion 461*a* is extended toward one end thereof to define a seventh differential signal extension portion 462*a* positioned at one side of the fourth grounding transmission conductor 43*a*, and one end of the seventh differential signal extension portion 462*a* defines a seventh differential signal soldering portion 463*a* positioned between the fourth grounding soldering portion 432*a* and the first power supply soldering portion 282*a*.

The eighth differential signal transmission conductor 47*a* is disposed on the second insulating substrate, positioned on one face of the fourth differential signal transmission conductor 27*a*, and juxtaposed with the seventh differential signal transmission conductor 46*a*, the eighth differential signal transmission conductor 47*a* defines an eighth differential signal bended portion 471*a* bended in a direction similar to the seventh differential signal bended portion 461*a*, and the eighth differential signal bended portion 471*a* is extended toward one end thereof to define an eighth differential signal extension portion 472*a* positioned at the side of the seventh differential signal extension portion 462*a* deviating from the fourth grounding transmission conductor 43*a*, and one end of the eighth differential signal extension portion 472*a* defines an eighth differential signal soldering portion 473*a* positioned between the seventh differential signal soldering portion 463*a* and the first power supply soldering portion 282*a*.

The shielding housing covers the first insulating substrate and second insulating substrate.

The above-mentioned grounding transmission conductor 20*a*, first signal transmission conductor 21*a*, second signal transmission conductor 22*a*, first differential signal transmission conductor 23*a*, second differential signal transmission conductor 24*a*, third grounding transmission conductor 25*a*, third differential signal transmission conductor 26*a*, fourth differential signal transmission conductor 27*a*, first power supply transmission conductor 28*a*, third signal transmission conductor 40*a*, fourth signal transmission conductor 41*a*, second power supply transmission conductor 42*a*, fourth grounding transmission conductor 43*a*, fifth differential signal transmission conductor 44*a*, sixth differential signal transmission conductor 45*a*, seventh differential signal transmission conductor 46*a* and eighth differential signal transmission conductor 47*a* are all connected to a printing circuit board at ends thereof. The connection way is the one selected from a group constituted by single row surface attachment (SMT), single row plug configuration (DIP), double row surface attachment (SMT), double-row plug configuration (DIP), upward bending extension (top mount), downward bending extension (reverse mount), continuous bending extension (sink boards). Furthermore, the top mount includes the one selected from a group constituted by top mount flush and top mount stand-off, the reverse mount includes reverse mount flush or reverse mount stand-off; the sink board includes forward sink board or backward sink board. Furthermore, the connection way may be vertical flush, vertical stand-off, vertical sink board, erect stand-off, erect flush or erect sink board, and a printing circuit board 7 is further connected with a conversion terminal set, the way of the printing circuit board connected to the conversion terminal set may be surface attachment (SMT), plug configuration (DIP) or clamp configuration.

Therefore, referring to all the figures, the present invention truly has the following advantages comparing with the prior arts:

Electric conduction can be carried out when a USB plug connector is plugged in a jack connector of the present invention positively or oppositely by means of the configuration of a plurality of transmission conductors and the particular arrangements thereof.

We claim:

1. A USB 3.0 two-way socket jack connector structure, comprising:

a grounding transmission conductor, one end thereof defining a first grounding contact portion bended oppositely, said first grounding contact portion being diverged at one end thereof and respectively extended with a first grounding extension portion and second grounding extension portion, a first grounding bended portion and first grounding soldering portion being defined on said first grounding extension portion, and a second grounding bended portion bended in a direction opposite to the first grounding bended portion and a second grounding soldering portion being defined on said second grounding extension portion, another end of said grounding transmission conductor being bended oppositely and extended to form a second grounding contact portion;

a first signal transmission conductor, positioned between said first grounding extension portion and second grounding extension portion, said first signal transmission conductor defining a first signal bended portion bended in a direction similar to said first grounding bended portion, and one end of said first signal transmission conductor defining a first signal soldering portion;

a second signal transmission conductor, positioned between said first signal transmission conductor and said second grounding extension portion, said second signal transmission conductor defining a second signal bended portion bended in a direction similar to said first signal bended portion, and one end of said second signal transmission conductor defining a second signal soldering portion;

a first differential signal transmission conductor, positioned at a side of said grounding transmission conductor, said first differential signal transmission conductor defining a first differential signal bended portion bended in a direction similarly to said first grounding bended portion, and one end of said first differential signal transmission conductor defining a first differential signal soldering portion positioned at a side of said first grounding soldering portion deviating from said first signal soldering portion;

a second differential signal transmission conductor, positioned at a side of said first differential signal transmission conductor deviating from said grounding transmission conductor, said second differential signal transmission conductor defining a second differential signal bended portion bended in a direction similar to said first differential signal bended portion, and one end of said second differential signal transmission conductor defining a second differential signal soldering portion;

a third grounding transmission conductor, positioned at a side of said second differential signal transmission conductor deviating from said first differential signal transmission conductor, said third grounding transmission conductor defining a third grounding bended portion bended in a direction similar to said second differential signal bended portion, and one end of said third grounding transmission conductor defining a third grounding soldering portion;

a third differential signal transmission conductor, positioned at a side of said grounding transmission conductor deviating from said first differential signal transmission conductor, said third differential signal transmission conductor defining a third differential signal bended portion bended in a direction similar to said second grounding bended portion, and one end of said third differential signal transmission conductor defining a third differential signal soldering portion;

a fourth differential signal transmission conductor, positioned at a side of said third differential signal transmission conductor deviating from said grounding transmission conductor, said fourth differential signal transmission conductor defining a fourth differential signal bended portion bended in a direction similar to said third differential signal bended portion, and one end of said fourth differential signal transmission conductor defining a fourth differential signal soldering portion;

a first power supply transmission conductor, positioned at a side of said fourth differential signal transmission conductor deviating from said third differential signal transmission conductor, said first power supply transmission conductor defining a first power supply bended portion bended in a direction similar to said fourth differential signal bended portion, and one end of said first power supply transmission conductor defining a first power supply soldering portion;

a third signal transmission conductor, positioned on one face of said first signal transmission conductor, said third signal transmission conductor defining a third signal bended portion bended in a direction opposite to said first signal bended portion, and one end of said third signal transmission conductor defining a third signal soldering portion positioned between said second signal soldering portion and said second grounding soldering portion;

a fourth signal transmission conductor, positioned on one face of said second signal transmission conductor, said fourth signal transmission conductor defining a fourth signal bended portion bended in a direction similar to said third signal bended portion, and one end of said fourth signal transmission conductor defining a fourth signal soldering portion positioned between said third signal soldering portion and said second grounding soldering portion;

a second power supply transmission conductor, positioned on one face of said third grounding transmission conductor, said second power supply transmission conductor defining a second power supply bended portion bended in a direction similar to said third grounding bended portion, and one end of said second power supply transmission conductor defining a second power supply soldering portion positioned between said second differential signal soldering portion and said third grounding soldering portion;

a fourth grounding transmission conductor, positioned on one face of said first power supply transmission conductor, said fourth grounding transmission conductor defining a fourth grounding bended portion bended in a direction similar to said first power supply bended portion, and one end of said fourth grounding transmission conductor defining a fourth grounding soldering portion positioned between said fourth differential signal soldering portion and said first power supply soldering portion;

a fifth differential signal transmission conductor, positioned on one face of said first differential signal transmission conductor, said fifth differential signal transmission conductor defining a fifth differential signal bended portion bended in a direction similar to said first differential signal bended portion, said fifth differential signal bended portion being extended toward one end thereof to define a fifth differential signal extension portion positioned at one side of said second power supply transmission conductor, and one end of said fifth differential signal extension portion defining a fifth differential signal soldering portion positioned between said second power supply soldering portion and said third grounding soldering portion;

a sixth differential signal transmission conductor, positioned on one face of said second differential signal transmission conductor, and juxtaposed with said fifth differential signal transmission conductor, said sixth differential signal transmission conductor defining a sixth differential signal bended portion bended in a direction similar to said fifth differential signal bended portion, and said sixth differential signal bended portion is extended toward one end thereof to define a sixth differential signal extension portion positioned at a side of said fifth differential signal extension portion deviating from said second power supply transmission conductor, and one end of said sixth differential signal extension portion defining a sixth differential signal soldering portion positioned between said fifth differential signal soldering portion and said third grounding soldering portion;

a seventh differential signal transmission conductor, positioned on one face of said third differential signal transmission conductor, said seventh differential signal transmission conductor defining a seventh differential signal bended portion bended in a direction similar to said third differential signal bended portion, and said seventh differential signal bended portion being extended toward one end thereof to define a seventh differential signal extension portion positioned at one side of said fourth grounding transmission conductor, and one end of said seventh differential signal extension portion defining a seventh differential signal soldering portion positioned between said fourth grounding soldering portion and said first power supply soldering portion; and an eighth differential signal transmission conductor, positioned on one face of said fourth differential signal transmission conductor, and juxtaposed with said seventh differential signal transmission conductor, said eighth differential signal transmission conductor defining an eighth differential signal bended portion bended in a direction similar to said seventh differential signal bended portion, and said eighth differential signal bended portion being extended toward one end thereof to define an eighth differential signal extension portion positioned at a side of said seventh differential signal extension portion deviating from said fourth grounding transmission conductor, and one end of said eighth differential signal extension portion defining an eighth differential signal soldering portion positioned between said seventh differential signal soldering portion and said first power supply soldering portion.

2. A USB 3.0 two-way socket jack connector structure, comprising:

a first insulating substrate;

a grounding transmission conductor, disposed on said first insulating substrate, one end thereof defining a first grounding contact portion bended oppositely, said first grounding contact portion being diverged at one end thereof and respectively extended with a first grounding extension portion and second grounding extension portion, a first grounding bended portion and first grounding soldering portion being defined on said first grounding extension portion, and a second grounding bended portion bended in a direction opposite to the first grounding bended portion and a second grounding soldering portion being defined on said second grounding extension portion, another end of said grounding transmission conductor being bended oppositely and extended to form a second grounding contact portion;

a first signal transmission conductor, disposed on said first insulating substrate, and positioned between said first grounding extension portion and second grounding extension portion, said first signal transmission conductor defining a first signal bended portion bended in a direction similar to said first grounding bended portion, and one end of said first signal transmission conductor defining a first signal soldering portion;

a second signal transmission conductor, disposed on said first insulating substrate, and positioned between said first signal transmission conductor and said second grounding extension portion, said second signal transmission conductor defining a second signal bended portion bended in a direction similar to said first signal bended portion, and one end of said second signal transmission conductor defining a second signal soldering portion;

a first differential signal transmission conductor, disposed on said first insulating substrate, and positioned at a side of said grounding transmission conductor, said first differential signal transmission conductor defining a first differential signal bended portion bended in a direction similarly to said first grounding bended portion, and one end of said first differential signal transmission conductor defining a first differential signal soldering portion positioned at a side of said first grounding soldering portion deviating from said first signal soldering portion;

a second differential signal transmission conductor, disposed on said first insulating substrate, and positioned at a side of said first differential signal transmission conductor deviating from said grounding transmission conductor, said second differential signal transmission conductor defining a second differential signal bended portion bended in a direction similar to said first differential signal bended portion, and one end of said second differential signal transmission conductor defining a second differential signal soldering portion;

a third grounding transmission conductor, disposed on said first insulating substrate, and positioned at a side of said second differential signal transmission conductor deviating from said first differential signal transmission conductor, said third grounding transmission conductor defining a third grounding bended portion bended in a direction similar to said second differential signal bended portion, and one end of said third grounding transmission conductor defining a third grounding soldering portion;

a third differential signal transmission conductor, disposed on said first insulating substrate, and positioned at a side of said grounding transmission conductor deviating from said first differential signal transmission conductor, said third differential signal transmission conductor defining a third differential signal bended portion bended in a direction similar to said second grounding bended portion, and one end of said third differential signal transmission conductor defining a third differential signal soldering portion;

a fourth differential signal transmission conductor, disposed on said first insulating substrate, and positioned at a side of said third differential signal transmission conductor deviating from said grounding transmission conductor, said fourth differential signal transmission conductor defining a fourth differential signal bended portion bended in a direction similar to said third differential signal bended portion, and one end of said fourth differential signal transmission conductor defining a fourth differential signal soldering portion;

a first power supply transmission conductor, disposed on said first insulating substrate, and positioned at a side of said fourth differential signal transmission conductor deviating from said third differential signal transmission conductor, said first power supply transmission conductor defining a first power supply bended portion bended in a direction similar to said fourth differential signal bended portion, and one end of said first power supply transmission conductor defining a first power supply soldering portion;

a second insulating substrate, stacked with and coupled to said first insulating substrate;

a third signal transmission conductor, disposed on said second insulating substrate, and positioned on one face of said first signal transmission conductor, said third signal transmission conductor defining a third signal bended portion bended in a direction opposite to said first signal bended portion, and one end of said third signal transmission conductor defining a third signal soldering portion positioned between said second signal soldering portion and said second grounding soldering portion;

a fourth signal transmission conductor, disposed on said second insulating substrate, and positioned on one face of said second signal transmission conductor, said fourth signal transmission conductor defining a fourth signal bended portion bended in a direction similar to said third signal bended portion, and one end of said fourth signal transmission conductor defining a fourth signal soldering portion positioned between said third signal soldering portion and said second grounding soldering portion;

a second power supply transmission conductor, disposed on said second insulating substrate, and positioned on one face of said third grounding transmission conductor, said second power supply transmission conductor defining a second power supply bended portion bended in a direction similar to said third grounding bended portion, and one end of said second power supply transmission conductor defining a second power supply soldering portion positioned between said second differential signal soldering portion and said third grounding soldering portion;

a fourth grounding transmission conductor, disposed on said second insulating substrate, and positioned on one face of said first power supply transmission conductor, said fourth grounding transmission conductor defining a fourth grounding bended portion bended in a direction similar to said first power supply bended portion, and one end of said fourth grounding transmission conductor defining a fourth grounding soldering portion positioned between said fourth differential signal soldering portion and said first power supply soldering portion;

a fifth differential signal transmission conductor, disposed on said second insulating substrate, and positioned on one face of said first differential signal transmission conductor, said fifth differential signal transmission conductor defining a fifth differential signal bended portion bended in a direction similar to said first differential signal bended portion, said fifth differential signal bended portion being extended toward one end thereof to define a fifth differential signal extension portion positioned at one side of said second power supply transmission conductor, and one end of said fifth differential signal extension portion defining a fifth differential signal soldering portion positioned between said second power supply soldering portion and said third grounding soldering portion;

a sixth differential signal transmission conductor, disposed on said second insulating substrate, and positioned on one face of said second differential signal transmission conductor, and juxtaposed with said fifth differential signal transmission conductor, said sixth differential signal transmission conductor defining a sixth differential signal bended portion bended in a direction similar to said fifth differential signal bended portion, and said sixth differential signal bended portion is extended toward one end thereof to define a sixth differential signal extension portion positioned at a side of said fifth differential signal extension portion deviating from said second power supply transmission conductor, and one end of said sixth differential signal extension portion defining a sixth differential signal soldering portion positioned between said fifth differential signal soldering portion and said third grounding soldering portion;

a seventh differential signal transmission conductor, disposed on said second insulating substrate, and positioned on one face of said third differential signal transmission conductor, said seventh differential signal transmission conductor defining a seventh differential signal bended portion bended in a direction similar to said third differential signal bended portion, and said seventh differential signal bended portion being extended toward one end thereof to define a seventh differential signal extension portion positioned at one side of said fourth grounding transmission conductor, and one end of said seventh differential signal extension portion defining a seventh differential signal soldering portion positioned between said fourth grounding soldering portion and said first power supply soldering portion; and an eighth differential signal transmission conductor, disposed on said second insulating substrate, and positioned on one face of said fourth differential signal transmission conductor, and juxtaposed with said seventh differential signal transmission conductor, said eighth differential signal transmission conductor defining an eighth differential signal bended portion bended in a direction similar to said seventh differential signal bended portion, and said eighth differential signal bended portion being extended toward one end thereof to define an eighth differential signal extension portion positioned at a side of said seventh differential signal extension portion deviating from said fourth grounding transmission conductor, and one end of said eighth differential signal extension portion defining an eighth differential signal soldering portion positioned between said seventh differential signal soldering portion and said first power supply soldering portion;

a shielding housing, covering said first insulating substrate and said second insulating substrate.

3. The structure according to claim 2, wherein said grounding transmission conductor, first signal transmission conductor, second signal transmission conductor, first differential signal transmission conductor, second differential signal transmission conductor, third grounding transmission conductor, third differential signal transmission conductor, fourth differential signal transmission conductor, first power supply transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor are all connected to a printing circuit board at ends thereof by means of upward bending extension (top mount), downward bending extension (reverse mount), continuous bending extension (sink boards), said top mount includes top mount flush or top mount stand-off, said reverse mount includes reverse mount flush or reverse mount stand-off; said sink board includes forward sink board or backward sink board, said connection way is vertical flush, vertical stand-off, vertical sink board, erect stand-off, erect flush or erect sink board.

4. The structure according to claim 3, wherein said printing circuit board is further connected with a conversion terminal set by means of surface attachment (SMT), plug configuration (DIP) or clamp configuration.

5. The structure according to claim 3, wherein said connection is further by means of single row surface attachment (SMT), single row plug configuration (DIP), double row surface attachment (SMT), or double-row plug configuration (DIP).

6. A USB 3.0 two-way socket jack connector structure, comprising:

a grounding transmission conductor, one end thereof defining a first grounding contact portion bended oppositely, said first grounding contact portion being diverged at one end thereof and respectively extended with a first grounding extension portion and second grounding extension portion, a first grounding bended portion and first grounding soldering portion being defined on said first grounding extension portion, and a second grounding bended portion bended in a direction opposite to said first grounding bended portion and a second grounding soldering portion being defined on said second grounding extension portion, another end of said grounding transmission conductor being bended oppositely and extended to form a second grounding contact portion;

a first signal transmission conductor, positioned between said first grounding extension portion and second grounding extension portion, said first signal transmission conductor defining a first signal bended portion bended in a direction opposite to said first grounding bended portion, and one end of said first signal transmission conductor defining a first signal soldering portion;

a second signal transmission conductor, positioned between said first signal transmission conductor and said second grounding extension portion, said second signal transmission conductor defining a second signal bended portion bended in a direction similar to said first signal bended portion, and one end of said second signal transmission conductor defining a second signal soldering portion;

a first differential signal transmission conductor, positioned at a side of said grounding transmission conductor, said first differential signal transmission conductor defining a first differential signal bended portion bended in a direction similarly to said first grounding bended portion, and one end of said first differential signal transmission conductor defining a first differential signal soldering portion positioned at a side of said first grounding soldering portion deviating from said first signal soldering portion;

a second differential signal transmission conductor, positioned at a side of said first differential signal transmission conductor deviating from said grounding transmission conductor, said second differential signal transmission conductor defining a second differential signal bended portion bended in a direction similar to said first differential signal bended portion, and one end of said second differential signal transmission conductor defining a second differential signal soldering portion;

a third grounding transmission conductor, positioned at a side of said second differential signal transmission conductor deviating from said first differential signal transmission conductor, said third grounding transmission conductor defining a third grounding bended portion bended in a direction similar to said second differential signal bended portion, and one end of said third grounding transmission conductor defining a third grounding soldering portion;

a third differential signal transmission conductor, positioned at a side of said grounding transmission conductor deviating from said first differential signal transmission conductor, said third differential signal transmission conductor defining a third differential signal bended portion bended in a direction similar to said second grounding bended portion, and one end of said third differential signal transmission conductor defining a third differential signal soldering portion;

a fourth differential signal transmission conductor, positioned at a side of said third differential signal transmission conductor deviating from said grounding transmission conductor, said fourth differential signal transmission conductor defining a fourth differential signal bended portion bended in a direction similar to said third differential signal bended portion, and one end of said fourth differential signal transmission conductor defining a fourth differential signal soldering portion;

a first power supply transmission conductor, positioned at a side of said fourth differential signal transmission conductor deviating from said third differential signal transmission conductor, said first power supply transmission conductor defining a first power supply bended portion bended in a direction similar to said fourth differential signal bended portion, and one end of said first power supply transmission conductor defining a first power supply soldering portion;

a third signal transmission conductor, positioned on one face of said first signal transmission conductor, said third signal transmission conductor defining a third signal bended portion bended in a direction opposite to said first signal bended portion, and one end of said third signal transmission conductor defining a third signal soldering portion positioned between said first signal soldering portion and said first grounding soldering portion;

a fourth signal transmission conductor, positioned on one face of said second signal transmission conductor, said fourth signal transmission conductor defining a fourth signal bended portion bended in a direction similar to said third signal bended portion, and one end of said fourth signal transmission conductor defining a fourth signal soldering portion positioned between said third signal soldering portion and said first signal soldering portion;

a second power supply transmission conductor, positioned on one face of said third grounding transmission conductor, said second power supply transmission conductor defining a second power supply bended portion bended in a direction similar to said third grounding bended portion, and one end of said second power supply transmission conductor defining a second power supply soldering portion positioned between said second differential signal soldering portion and said third grounding soldering portion;

a fourth grounding transmission conductor, positioned on one face of said first power supply transmission conductor, said fourth grounding transmission conductor defining a fourth grounding bended portion bended in a direction similar to said first power supply bended portion, and one end of said fourth grounding transmission conductor defining a fourth grounding soldering portion positioned between said fourth differential signal soldering portion and said first power supply soldering portion;

a fifth differential signal transmission conductor, positioned on one face of said first differential signal transmission conductor, said fifth differential signal transmission conductor defining a fifth differential signal bended portion bended in a direction similar to said first differential signal bended portion, said fifth differential signal bended portion being extended toward one end thereof to define a fifth differential signal extension portion positioned at one side of said second power supply transmission conductor, and one end of said fifth differential signal extension portion defining a fifth differential signal soldering portion positioned between said second power supply soldering portion and said third grounding soldering portion;

a sixth differential signal transmission conductor, positioned on one face of said second differential signal transmission conductor, and juxtaposed with said fifth differential signal transmission conductor, said sixth differential signal transmission conductor defining a sixth differential signal bended portion bended in a direction similar to said fifth differential signal bended portion, and said sixth differential signal bended portion being extended toward one end thereof to define a sixth differential signal extension portion positioned at a side of said fifth differential signal extension portion deviating from said second power supply transmission conductor, and one end of said sixth differential signal extension portion defining a sixth differential signal soldering portion positioned between said fifth differential signal soldering portion and said third grounding soldering portion;

a seventh differential signal transmission conductor, positioned on one face of said third differential signal transmission conductor, said seventh differential signal transmission conductor defining a seventh differential signal bended portion bended in a direction similar to said third differential signal bended portion, and said seventh differential signal bended portion being extended toward one end thereof to define a seventh differential signal extension portion positioned at one side of said fourth grounding transmission conductor, and one end of said seventh differential signal extension portion defining a seventh differential signal soldering portion positioned between said fourth grounding soldering portion and said first power supply soldering portion; and an eighth differential signal transmission conductor, positioned on one face of said fourth differential signal transmission conductor, and juxtaposed with said seventh differential signal transmission conductor, said eighth differential signal transmission conductor defining an eighth differential signal bended portion bended in a direction similar to said seventh differential signal bended portion, and said eighth differential signal bended portion being extended toward one end thereof to define an eighth differential signal extension portion positioned at a side of said seventh differential signal extension portion deviating from said fourth grounding transmission conductor, and one end of said eighth differential signal extension portion defining an eighth differential signal soldering portion positioned between said seventh differential signal soldering portion and said first power supply soldering portion.

7. A USB 3.0 two-way socket jack connector structure, comprising:

a first insulating substrate;

a grounding transmission conductor, disposed on said first insulating substrate, one end thereof defining a first grounding contact portion bended oppositely, said first grounding contact portion being diverged at one end thereof and respectively extended with a first grounding extension portion and second grounding extension portion, a first grounding bended portion and first grounding soldering portion being defined on said first grounding extension portion, and a second grounding bended portion bended in a direction opposite to said first grounding bended portion and a second grounding soldering portion being defined on said second grounding extension portion, another end of said grounding transmission conductor being bended oppositely and extended to form a second grounding contact portion;

a first signal transmission conductor, disposed on said first insulating substrate, and positioned between said first grounding extension portion and second grounding extension portion, said first signal transmission conductor defining a first signal bended portion bended in a direction opposite to said first grounding bended portion, and one end of said first signal transmission conductor defining a first signal soldering portion;

a second signal transmission conductor, disposed on said first insulating substrate, and positioned between said first signal transmission conductor and said second grounding extension portion, said second signal transmission conductor defining a second signal bended portion bended in a direction similar to said first signal bended portion, and one end of said second signal transmission conductor defining a second signal soldering portion;

a first differential signal transmission conductor, disposed on said first insulating substrate, and positioned at a side of said grounding transmission conductor, said first differential signal transmission conductor defining a first differential signal bended portion bended in a direction similarly to said first grounding bended portion, and one end of said first differential signal transmission conductor defining a first differential signal soldering portion positioned at a side of said first grounding soldering portion deviating from said first signal soldering portion;

a second differential signal transmission conductor, disposed on said first insulating substrate, and positioned at a side of said first differential signal transmission conductor deviating from said grounding transmission conductor, said second differential signal transmission conductor defining a second differential signal bended portion bended in a direction similar to said first differential signal bended portion, and one end of said second differential signal transmission conductor defining a second differential signal soldering portion;

a third grounding transmission conductor, disposed on said first insulating substrate, and positioned at a side of said second differential signal transmission conductor deviating from said first differential signal transmission conductor, said third grounding transmission conductor defining a third grounding bended portion bended in a direction similar to said second differential signal bended portion, and one end of said third grounding transmission conductor defining a third grounding soldering portion;

a third differential signal transmission conductor, disposed on said first insulating substrate, and positioned at a side of said grounding transmission conductor deviating from said first differential signal transmission conductor, said third differential signal transmission conductor defining a third differential signal bended portion bended in a direction similar to said second grounding bended portion, and one end of said third differential signal transmission conductor defining a third differential signal soldering portion;

a fourth differential signal transmission conductor, disposed on said first insulating substrate, and positioned at a side of said third differential signal transmission conductor deviating from said grounding transmission conductor, said fourth differential signal transmission conductor defining a fourth differential signal bended portion bended in a direction similar to said third differential signal bended portion, and one end of said fourth differential signal transmission conductor defining a fourth differential signal soldering portion;

a first power supply transmission conductor, disposed on said first insulating substrate, and positioned at a side of said fourth differential signal transmission conductor deviating from said third differential signal transmission conductor, said first power supply transmission conductor defining a first power supply bended portion bended in a direction similar to said fourth differential signal bended portion, and one end of said first power supply transmission conductor defining a first power supply soldering portion;

a second insulating substrate, stacked with and coupled to said first insulating substrate;

a third signal transmission conductor, disposed on said second insulating substrate, and positioned on one face of said first signal transmission conductor, said third signal transmission conductor defining a third signal bended portion bended in a direction opposite to said first signal bended portion, and one end of said third signal transmission conductor defining a third signal soldering portion positioned between said first signal soldering portion and said first grounding soldering portion;

a fourth signal transmission conductor, disposed on said second insulating substrate, and positioned on one face of said second signal transmission conductor, said fourth signal transmission conductor defining a fourth signal bended portion bended in a direction similar to said third signal bended portion, and one end of said fourth signal transmission conductor defining a fourth signal soldering portion positioned between said third signal soldering portion and said first signal soldering portion;

a second power supply transmission conductor, disposed on said second insulating substrate, and positioned on one face of said third grounding transmission conductor, said second power supply transmission conductor defining a second power supply bended portion bended in a direction similar to said third grounding bended portion, and one end of said second power supply transmission conductor defining a second power supply soldering portion positioned between said second differential signal soldering portion and said third grounding soldering portion;

a fourth grounding transmission conductor, disposed on said second insulating substrate, and positioned on one face of said first power supply transmission conductor, said fourth grounding transmission conductor defining a fourth grounding bended portion bended in a direction similar to said first power supply bended portion, and one end of said fourth grounding transmission conductor defining a fourth grounding soldering portion positioned between said fourth differential signal soldering portion and said first power supply soldering portion;

a fifth differential signal transmission conductor, disposed on said second insulating substrate, and positioned on one face of said first differential signal transmission conductor, said fifth differential signal transmission conductor defining a fifth differential signal bended portion bended in a direction similar to said first differential signal bended portion, said fifth differential signal bended portion being extended toward one end thereof to define a fifth differential signal extension portion positioned at one side of said second power supply transmission conductor, and one end of said fifth differential signal extension portion defining a fifth differential signal soldering portion positioned between said second power supply soldering portion and said third grounding soldering portion;

a sixth differential signal transmission conductor, disposed on said second insulating substrate, and positioned on one face of said second differential signal transmission conductor, and juxtaposed with said fifth differential signal transmission conductor, said sixth differential signal transmission conductor defining a sixth differential signal bended portion bended in a direction similar to said fifth differential signal bended portion, and said sixth differential signal bended portion being extended toward one end thereof to define a sixth differential signal extension portion positioned at a side of said fifth differential signal extension portion deviating from said second power supply transmission conductor, and one end of said sixth differential signal extension portion defining a sixth differential signal soldering portion positioned between said fifth differential signal soldering portion and said third grounding soldering portion;

a seventh differential signal transmission conductor, disposed on said second insulating substrate, and positioned on one face of said third differential signal transmission conductor, said seventh differential signal transmission conductor defining a seventh differential signal bended portion bended in a direction similar to said third differential signal bended portion, and said seventh differential signal bended portion being extended toward one end thereof to define a seventh differential signal extension portion positioned at one side of said fourth grounding transmission conductor, and one end of said seventh differential signal extension portion defining a seventh differential signal soldering portion positioned between said fourth grounding soldering portion and said first power supply soldering portion;

an eighth differential signal transmission conductor, positioned on one face of said fourth differential signal transmission conductor, and juxtaposed with said seventh differential signal transmission conductor, said eighth differential signal transmission conductor defining an eighth differential signal bended portion bended in a direction similar to said seventh differential signal bended portion, and said eighth differential signal bended portion being extended toward one end thereof to define an eighth differential signal extension portion positioned at a side of said seventh differential signal extension portion deviating from said fourth grounding transmission conductor, and one end of said eighth differential signal extension portion defining an eighth differential signal soldering portion positioned between said seventh differential signal soldering portion and said first power supply soldering portion; and a shielding housing, covering said first insulating housing and said second insulating housing.

8. The structure according to claim 7, wherein said grounding transmission conductor, first signal transmission conductor, second signal transmission conductor, first differential signal transmission conductor, second differential signal transmission conductor, third grounding transmission conductor, third differential signal transmission conductor, fourth differential signal transmission conductor, first power supply transmission conductor, third signal transmission conductor, fourth signal transmission conductor, second power supply transmission conductor, fourth grounding transmission conductor, fifth differential signal transmission conductor, sixth differential signal transmission conductor, seventh differential signal transmission conductor and eighth differential signal transmission conductor are all connected to a printing circuit board at ends thereof by means of upward bending extension (top mount), downward bending extension (reverse mount), continuous bending extension (sink boards), said top mount includes top mount flush or top mount stand-off, said reverse mount includes reverse mount flush or reverse mount stand-off, said sink board includes forward sink board or backward sink board, said connection way is vertical flush, vertical stand-off, vertical sink board, erect stand-off, erect flush or erect sink board.

9. The structure according to claim 8, wherein said printing circuit board is further connected with a conversion terminal set by means of surface attachment (SMT), plug configuration (DIP) or clamp configuration.

10. The structure according to claim 8, wherein said connection is further by means of single row surface attachment (SMT), single row plug configuration (DIP), double row surface attachment (SMT), or double-row plug configuration (DIP).

* * * * *